US005633416A

United States Patent [19]

Chauvin et al.

[11] Patent Number: 5,633,416

[45] Date of Patent: May 27, 1997

[54] FUEL PRODUCED BY A PROCESS COMPRISING ETHERIFICATION OF A HYDROCARBON FRACTION COMPRISING OLEFINS CONTAINING 5 TO 8 CARBON ATOMS

[75] Inventors: Yves Chauvin, Le Pecq; Alain Forestiere, Vernaison; Marie-Claire Marion, Villeurbanne; Hélène Olivier, Rueil Malmaison; Patrick Sarrazin, Rueil Malmaison; Jean-Luc Nocca, Rueil Malmaison, all of France

[73] Assignee: Institut Francais du Petrole, Rueil-Malmaison, France

[21] Appl. No.: 459,691

[22] Filed: Jun. 2, 1995

Related U.S. Application Data

[63] Continuation of Ser. No. 251,685, May 31, 1994, abandoned.

[30] Foreign Application Priority Data

May 28, 1993 [FR] France ..... 92 06474

[51] Int. Cl.$^6$ ..... C07C 5/22; C07C 5/27; C07C 41/00

[52] U.S. Cl. ..... 585/324; 585/310; 585/329; 585/332; 585/654; 568/697

[58] Field of Search ..... 585/310, 324, 585/329, 332, 654; 568/697

[56] References Cited

U.S. PATENT DOCUMENTS

| | | | |
|---|---|---|---|
| 3,902,870 | 9/1975 | Rollmann et al. | 44/56 |
| 5,198,590 | 3/1993 | Sofranko et al. | 568/697 |
| 5,264,635 | 11/1993 | Le et al. | 568/697 |

FOREIGN PATENT DOCUMENTS

| | | |
|---|---|---|
| 43478 | 1/1982 | European Pat. Off. . |
| 0454304 | 10/1991 | European Pat. Off. . |
| 0451989 | 10/1991 | European Pat. Off. . |
| 2535471 | 11/1976 | Germany . |

*Primary Examiner*—Ponnathapura Achutamurthy
*Attorney, Agent, or Firm*—Millen, White, Zelano & Branigan, P.C.

[57] ABSTRACT

An internal combustion engine fuel is produced from a mixture of hydrocarbons comprising olefinic hydrocarbons containing 5 to 8 carbon atoms characterized in that it is produced by a process comprising a) a catalytic etherification step for at least a portion of the etherifiable olefins contained in said hydrocarbon mixture, using at least one alcohol containing 1 to 4 carbon atoms, the quantity of alcohol employed being such that the alcohol:etherifiable olefin molar ratio is at least 1:1, and b) a water washing step for the ether-containing product before recovery as a fuel.

8 Claims, 2 Drawing Sheets

FUEL PRODUCED BY A PROCESS COMPRISING ETHERIFICATION OF A HYDROCARBON FRACTION COMPRISING OLEFINS CONTAINING 5 TO 8 CARBON ATOMS

This application is a continuation of application Ser. No. 08/251,685, filed 31 May 1994, now abandoned.

BACKGROUND OF THE INVENTION

The invention concerns a process for improving the quality of olefinic fuels, in particular those produced by oligomerisation of light olefins. It also concerns an optimised process for etherification of olefinic fractions, particularly those from dimerisation or oligomerisation of light olefins.

The present invention more particularly concerns a fuel for an internal combustion engine produced from a mixture of hydrocarbons comprising olefinic hydrocarbons containing 5 to 8 carbon atoms, characterised in that it is produced by a process comprising an etherification step and a washing step.

Hydrocarbon mixtures containing olefinic hydrocarbons are volatile fuels (since they usually contain high proportions of hydrocarbons containing less than 6 carbon atoms). Many areas of the world are now bringing in legislation which imposes new constraints on volatility and olefin content of gasolines, thus severely limiting the use of olefins in fuels.

The processes described below reduce both vapour tension and olefin content of the fuels produced by maximising etherification of the olefins present, in particular the hexenes. These processes also produce gasolines containing oxygenated compounds which are desirable particularly for their high octane numbers (RON and MON). They also increase the overall quantity of in fine fuel produced by addition of chemically bound alcohols.

Homogeneous phase propylene oligomerisation processes using acid or organometallic catalysts, as in the DIMERSOL G (Trade Mark) process, result inter alia in the production of non linear, branched olefins.

A process for homogeneous phase ethylene or ethylene/propylene mixture oligomerisation using an organometallic catalyst, known as the DIMERSOL E (Trade Mark) process also results, inter alia, in the production of non linear, branched olefins.

DIMERSOL (Trade Mark) processes are described by BENEDEK et al in "Oil and Gas Journal", April 1980, p 77–83. A general description of DIMERSOL processes can also be found in the assignees U.S. Pat. Nos. 4,283,305, 4,316,851, 4,366,087 and 4,398,049.

Oligomerisation processes for light olefins by heterogeneous catalysis employ metals such as nickel deposited on organic or mineral supports. These processes also produce, inter alia, non linear, branched olefins. These processes are in particular described in European patent EP-B-272 970.

Olefins from the processes described above are preferably used. However, it should be noted that the origin of the olefins for etherification in the processes described in the following description is not critical: products from cracking, in particular catalytic cracking, steam cracking or any other olefin synthesis process, for example the process known as the Fischer-Tropsch process, can be both etherified and/or treated provided that said processes can produce branched olefins.

The skilled person is well aware that branched olefins containing an internal triple-substituted carbon-carbon double bond or an external double substituted double bond react with alcohols in the presence of an acid catalyst to form ethers. This reaction is employed to produce MTBE (Methyl TerButylEther) or ETBE (Ethyl TerButylEther). Further, methanol or ethanol can be added to 2-methylpropene to produce TAME (TerAmylMethylEther) or ETAE (TerAmylEthylEther).

Methanol or ethanol can also be added to 2-methyl 1-butene and to 2-methyl 2-butene.

In the latter case it should be noted that there is only one other methyl-butene isomer, 3-methyl 1-butene, which does not react in the presence of an acid.

C6 fractions from ethylene or propylene oligomerisation and linear olefins which are unaffected by the etherification reaction also contain branched olefins which are not directly etherifiable: those where the internal carbon-carbon double bond is not trisubstituted or where the carbon-carbon double bond is monosubstituted. The development of methods which can optimise transformation of branched olefins into etherifiable olefins in an olefin mixture is therefore of great interest.

In general, for a given olefinic structure, the preferred low temperature isomer is the internal olefin with a trisubstituted carbon-carbon double bond. Transforming a non etherifiable branched olefin into an etherifiable branched olefin consists in bringing the compound into thermodynamic equilibrium, ie, accelerating the migration rate of the double bond along the hydrocarbon chain.

Certain heavy metals can operate this mechanism in the presence of hydrogen: Hydrocarbon Processing, May 1992, pages 86–88 describes a system wherein palladium fixed on an acid resin in the presence of hydrogen encourages isomerisation of 3-methyl 1-butene to 2-methyl butenes which can then be transformed into TAME by addition of methanol in the presence of the same catalyst.

The operation is facilitated by the fact that the amount of 3-methyl 1-butene present is relatively low, not exceeding about 5 mol %.

SUMMARY OF THE INVENTION

The present invention concerns a combination of processes which can optimise etherification of potentially etherifiable olefins contained in light fractions comprising olefinic hydrocarbons containing less than 8 carbon atoms, preferably between 5 and 7 carbon atoms. These fractions may have been extracted from catalytic cracking or steam cracking effluents, or from olefin production units including light olefin dimerisation and oligomerisation units.

The invention particularly concerns a fuel for an internal combustion engine produced from a hydrocarbon mixture comprising etherifiable and non-etherifiable hydrocarbons containing 5 to 8 carbon atoms, characterised in that it is obtained by a process comprising:

- a catalytic etherification step for at least a portion of the etherifiable olefins contained in said hydrocarbon mixture, by means of at least one alcohol containing 1 to 4 carbon atoms, the quantity of alcohol employed being such that the alcohol:etherifiable molar ratio is at least 1:1, preferably about 1:1 to about 5:1, and
- a water washing step for the ether-containing product before its recovery as a fuel.

In a particular embodiment, the process comprises a distillation step for the hydrocarbon mixture comprising the olefinic hydrocarbons containing 5 to 8 carbon atoms, during which a top fraction which is enriched in hydrocarbons containing 6 carbon atoms is separated and transported to the etherification step and a bottom fraction which is enriched in hydrocarbons containing more than 6 carbon atoms is recovered.

Following the distillation step, the process may also comprise an isomerisation step for the top fraction which is enriched in hydrocarbons containing 6 carbon atoms, wherein the linear olefins present are at least partially isomerised to branched olefins comprising at least three hydrocarbon moieties on the double bonded carbon atoms and the isomerised product is then transported to the etherification step.

The isomerisation step may in particular be carried out in the presence of hydrogen.

In a particular embodiment of the invention, the process comprises a distillation step for the mixture from the etherification step, during which an ether enriched bottom fraction is separated and recovered and a hydrocarbon enriched top fraction is transported to the washing step In accordance with this embodiment, before the washing step, the process also includes a second etherification step for the hydrocarbon enriched top fraction from the distillation step, wherein the ether enriched product is recovered and transported to the washing step.

BRIEF DESCRIPTION OF THE DRAWINGS

In summary, this invention provides a method of reducing the olefinic nature of a gasoline by transforming at least a portion of the olefins contained in the gasoline into ethers whose properties are appreciated by fuel blenders. Several embodiments of the present invention will now be described with reference to the schematic flow chart of FIGS. 1 to 4, in which similar elements are designated by the same reference numerals or letters.

DETAILED DESCRIPTION OF FIGURES

Figure 1:
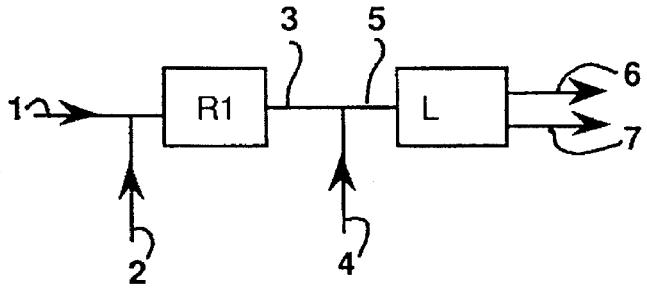

In process A, transformation is achieved by addition of an alcohol to etherifiable olefins contained in an oligomerised gasoline or any other olefinic gasoline, in the presence of a cationic resin or any other acid type catalyst. Process A is illustrated in example 1 and FIG. 1. Following the etherification step, a mixture of ethers, olefins and alcohol is obtained. The alcohol, usually methanol, is extracted by washing with water and can be recycled after distillation; the residual ethers and olefins can be used as fuels. Hydrocarbon feedstock is introduced via line (1) and alcohol is introduced via line (2) into etherification reactor (R2). The etherification effluent is transported via lines (3) and (5) to water washing zone (L) which is supplied with water by lines (4) and (5). The organic phase is recovered via line (6) and an aqueous phase containing mainly water and unreacted alcohol from the etherification zone is recovered via line (7).

In process B, the ethers are produced by treatment of only a portion of the olefins (typically the C6 fraction) which is separated by distillation of a gasoline as defined above in the description for process A. The treatment follows the technique described for process A. Process B is illustrated in example 2 and FIG. 2. The olefin-containing hydrocarbon fraction is introduced via line (1) into distillation zone (D1) from which a bottom product containing heavy products (C6=+) and a top product containing light products and the C6= fraction are recovered. The top product is transported via lines (3) and (5) to etherification reactor (R1) which is supplied with alcohol via lines (4) and (5). The etherification product is transported via line (6) to a second distillation zone (D2) from which a bottom product containing the majority of the ethers formed is recovered via line (7) and a top product is recovered which is transported via line (8) to washing zone (L). The washing zone is supplied with water via line (9). The organic phase is recovered via line (10) and an aqueous phase containing mainly water and unreacted alcohol from the etherification zone is recovered via line (11).

When using methanol as the alcohol in this case, a mixture of ethers, unreacted olefins and methanol is obtained after the etherification reaction which is distilled to produce a bottom ether fraction and a top olefinic fraction which azeotropically contains almost all the methanol in the effluent from the etherification unit.

This distillate is treated as described in process A, ie, by washing with water to produce recyclable methanol (after distillation) and an olefinic fraction which can be used a sa gasoline. The fraction containing the ethers is also usually used as a fuel but it is usually fairly pure and therefore has other chemical uses, in particular for the production of purified olefins by application of a reverse chemical process consisting in conventional transformation of the ethers into mixtures of olefins and alcohols in the presence of an acid catalyst.

More ethers or greater olefin conversion is achieved in process C by operating on the fraction defined in process B after it has undergone an isomerisation operation to transform a portion of the non etherifiable olefins into olefins which can add to alcohols in the presence of an acid catalyst. This process is illustrated in Example 3 and FIG. 3. The olefin-containing hydrocarbon fraction is introduced via line (1) into distillation zone (D1) from which a bottom product containing heavy products (C6=+) and a top product containing light products and the C6= fraction are recovered. The top product is transported via lines (3) and (5) to hydroisomerisation reactor (R1) which is supplied with hydrogen via lines (4) and (5). The isomerisation product is transported via line (7) to etherification reactor (R2) which is supplied with alcohol via lines (6) and (7). The etherification product is transported via line (8) to a second distillation zone (D2) from which a bottom product containing the majority of the ethers formed is recovered via line (9) and a top product is recovered which is transported via line (1)) to washing zone (L). The washing zone is supplied with water via line (11). The organic phase is recovered via line (12) and an aqueous phase containing mainly water and unreacted alcohol from the etherification zone is recovered via line (13).

Example 3 only describes improvement of a C6 fraction from an oligomerised gasoline. As mentioned in the description of process A, however, this is also applicable to any olefinic fraction from all or a portion of an olefinic gasoline.

Thus the hydrocarbon mixture treated in the process of the present invention can be a mixture comprising olefinic hydrocarbons containing 5 to 8 carbon atoms or a mixture resulting from homogeneous or heterogeneous phase catalytic oligomerisation of at least one olefin containing 2 to 4 carbon atoms under conditions which will produce at least one branched olefin containing 5 to 8 carbon atoms comprising an internal triple-substituted carbon-carbon double bond or an external double-substituted double bond. It may also be a mixture comprising olefinic hydrocarbons containing 5 to 8 carbon atoms from a cracking reaction.

The field of the present invention is not solely limited to the techniques of isomerisation or hydroisomerisation: any catalytic or thermal technique which accelerates the equilibrium process (preferably at low temperature) of a mixture of olefins falls within the scope of the present invention.

In process D, the process described above is used to etherify all or a portion of an olefinic oligomerised gasoline using methanol, after the quantity of etherifiable olefins has been increased to the detriment of the non linear, non etherifiable olefins. This is achieved simply by increasing the residence time in an end reactor in the presence of an oligomerisation catalyst.

Such an end reactor increases the conversion yield in the oligomerisation process by better use of the homogeneous oligomerisation catalyst.

Figure 2:
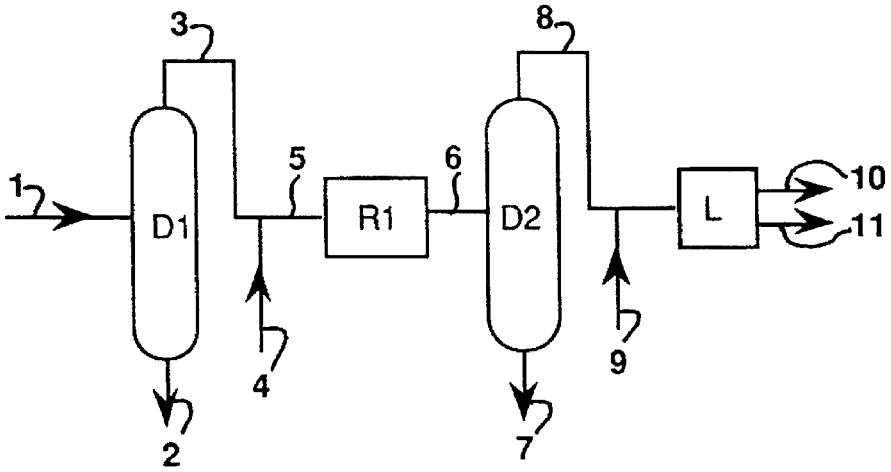

This process is illustrated in Example 4 and FIG. 2. Example 4 only describes improvement of a C6 fraction from an oligomerised gasoline. As mentioned in the description of process A, however, this is also applicable to any olefinic fraction from all or a portion of an olefinic gasoline.

The field of the present invention is not solely limited to the technique of an end reactor in an oligomerisation process using a homogeneous catalyst: any catalytic or thermal technique which accelerates the equilibrium process of a mixture of olefins at low temperature falls within the scope of the present invention.

Figure 3:
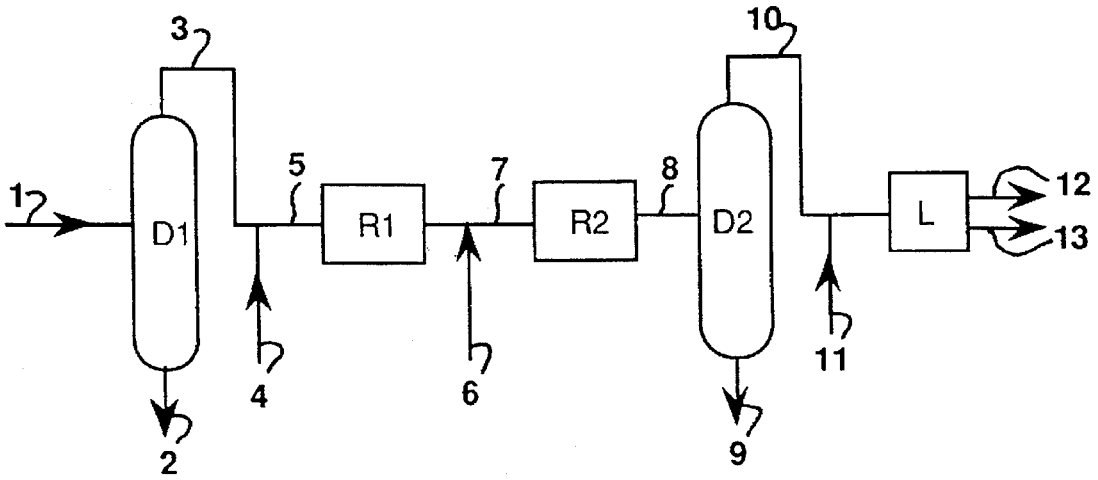

In the case shown in FIG. 2 it can be seen that, contrary to process C illustrated in FIG. 3, the olefins which are to be etherified are separated in a step which follows the operation of increasing the quantity of etherifiable olefins. The operations following the etherification operation are clearly identical and comments made regarding the fate of the various effluent are clearly valid in this instance as well.

In process E, after etherifying once as described for process D, the top effluent from column (D2) containing almost all the unreacted methanol and etherifiable olefins is fed to an end reactor which increases the conversion yield of these olefins. Distillation eliminates the addition reaction product of the methanol and etherifiable olefins. Applying Le Chatelier's principle, it can be seen that conversion of the etherifiable olefins resumes in the end reactor but is limited at the exit to the first reactor. This process is illustrated in example 5 and FIG. 4. The olefin-containing hydrocarbon fraction is introduced via line (1) into distillation zone (D1) from which a bottom product which contains heavy products (C6=+) and a top product containing light products and the C6= fraction are recovered. The top product is transported via lines (3) and (5) to etherification reactor (R1) which is supplied with alcohol via lines (4) and (5). The etherification product is transported via line (6) to a second distillation zone (D2) from which a bottom product containing the majority of the ethers formed in reactor (R1) is recovered via line (7) and a top product is transported to a second etherification reactor (R2) which is supplied with alcohol via lines (4) and (5). The etherification product is transported via line (9) to a third distillation zone (D3) from which a bottom portion is recovered via line (10) which contains the majority of the ethers formed in reactor (R2) and a top product is recovered which is transported via line (11) to washing zone (L). The washing zone is supplied with water via line (12). The organic phase is recovered from the washing zone via line (13) and an aqueous phase containing mainly water and unreacted alcohol from the etherification zone is recovered via line (14).

Figure 4:
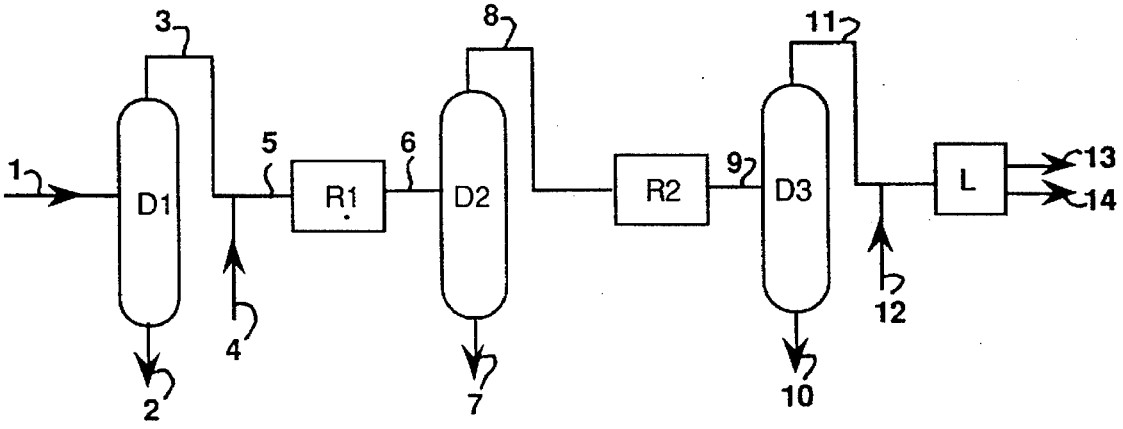

As shown in FIG. 4, the effluent from the second etherification reactor may be distilled again in a second column to produce extra ether and a methanol/olefin mixture which is then treated as described for processes B, C and D.

The effluent from the second etherification reactor does not have to be distilled: it can be treated as described for process A, but in this case there is no supplementary ether production.

A portion of the effluent from the second etherification reactor can be recycled to the column following the first etherification reactor as described in our French patent application filed on 1st Jul. 1992 with national registration number EN 92/08190. In this instance, ether production is improved and the non recycled portion is treated as described for process A.

The cases described above show that different types of effluents are obtained from a cracked or oligomerised gasoline. The heaviest products, except for those from process A, are removed by distillation at the end of the process since there is a risk, if the starting gasoline has not been properly cut, of producing even heavier products which exceed the gasoline specification: these heavy products can nevertheless be reintroduced into the fuels if required: their rate of formation remains much lower than those for the production of ethers described in the present invention. Except for process A, alcohol addition is carried out only on a controlled olefin cut. Thus in fine blending can be effected and the ethers formed, if necessary after increasing the quantity of etherifiable olefins using the means described with reference to processes C and D, can be isolated as bottom distillation products. Methanol or any other alcohol which can be used in the present invention can be recovered from the top of the distillation column by azeotropy, along with the non etherifiable olefins or those which have not been etherified because of chemical equilibria. The methanol can be separated from a hydrocarbon fraction by extraction with water or by any other method, for example a pervaporation technique, and recycled after appropriate treatment. The fraction can be reintegrated into the starting gasoline.

The distillation step following the etherification reactor allows the alcohol/olefin mixture to be recovered from the top of the column and thus increases the conversion yield of etherifiable olefins, as described for process E illustrated in FIG. 4.

The processes described above advantageously employ an alcohol containing one to four carbon atoms. Methanol and ethanol are preferred, however, since the ethers they produce on addition to hexenes have boiling points which are perfectly compatible with their use as fuel components.

EXAMPLE 1

This example illustrates direct etherification of a gasoline fraction produced from an industrial DIMERSOL G unit.

An olefinic gasoline was removed from the effluent from a DIMERSOL G type propylene dimerisation-oligomerisation unit (homogeneous phase nickel catalyst).

This gasoline was mainly constituted by hexenes as seen in Table 1 which shows the analysis of the DIMATE employed. ("DIMATE" is a compound term used to designate the product obtained from the dimerization of olefin cuts, especially from an industrial DIMERSOL unit.)

TABLE 1

| olefinic constituents | C3= | C6= | C9= | C12= |
|---|---|---|---|---|
| composition (weight %) | 2.44 | 74.88 | 17.83 | 5.25 |

Table 2 shows the individual chemical composition of the major C6fraction of the gasoline.

TABLE 2

| Product name | Composition (weight %) |
|---|---|
| n-hexane | — |
| 1-hexene | 0.30 |
| 2-hexene trans | 13.17 |
| 2-hexene cis | 3.78 |
| 3-hexene cis + trans | 5.29 |
| 2-methyl pentane | — |
| 2-methyl 1-pentene | 5.93 |
| 2-methyl 2-pentene | 42.09 |
| 4-methyl 2-pentene trans | 18.13 |
| 4-methyl 2-pentene cis | 2.97 |
| 4-methyl 1-pentene | 0.89 |
| 2,3-dimethylbutane | — |
| 2,3-dimethyl 1-butene | 1.98 |
| 2,3-dimethyl 2-butene | 5.47 |

A sample of the gasoline (about 100 kg) was reacted by addition with methanol (53 kg) such that the ratio between the methanol and the etherifiable olefins contained in the C6 fraction (the sum of the 2-methylpentenes and the 2,3-dimethylbutenes) was 2.6.

The mixture was brought into contact with a sulphonic acid resin (sold by ROHM & HAAS under the trade name AMBERLYST 15) in an apparatus whose operating principles are described below.

The pilot unit used 220 ml (89 g dry material) of AMBERLYST 15 catalyst in a pressurised tube reactor with a 20 mm diameter (the experiment was conducted under a controlled pressure of 1 MPa (megapascal) in the reaction zone). The reactor contained electrically heated baffles to ensure pseudo-isothermal operation at about 70° C. in the reaction zone.

After preheating the feedstock in a furnace, the reaction zone was supplied with an ascending flow of dimate-methanol mixture driven by a metering pump from external storage. The flow rate was held at a constant rate of about 128 g/h corresponding to a specific hourly flow rate (vvh) of about 0.8 $h^{-1}$.

After cooling with water at the exit to the reactor, the mixture was transported to a vessel where the pressure was released to 0.5 MPa; the pressure in the vessel was maintained by continuous injection of a current of nitrogen (about 10 N.l/h). Releasing the pressure to atmospheric pressure transported the effluent from the unit for storage in another vessel.

Periodically, a minimum of once a day, a sample of the liquid was removed and analysed by vapour phase chromatography. The conversion yield, formation of dimethylether (by dehydration of methanol) and the formation of 2-methyl 2-pentanol and 2,3-dimethyl 2-butanol could thus be followed; the latter alcohols are the result of addition of water to hexenes which are reactive under the test conditions.

The experiment was continued for two months without observing any catalyst deactivation or significant variations in the conversion yield or the nature of the products formed.

The two main identifiable ethers formed were 2-methyl 2-methoxypentane and 2,3-dimethyl 2-methoxybutane which are known to result from addition of methanol to 2-methylpentenes and 2,3-dimethylbutenes. Other ethers were also formed, particularly from the reactive compounds corresponding to C9= and C12= olefins. These heavy products were not formally identified.

The effluent from the etherification unit was then transported to a water washing zone from which an aqueous phase containing mainly water and methanol and an organic phase forming a gasoline fraction was recovered.

Table 3 shows the approximate average composition of the dimate-methanol feedstock, the etherification effluents produced and the gasoline formed.

TABLE 3

| Product name | Feedstock (wt %) | Effluent (wt %) | Gasoline (wt %) |
|---|---|---|---|
| C3 | 1.60 | 1.60 | — |
| n-hexane | — | — | — |
| 1-hexene | 0.15 | 0.15 | 0.21 |
| 2-hexene trans | 6.42 | 6.42 | 9.03 |
| 2-hexene cis | 1.84 | 1.84 | 2.59 |
| 3-hexene cis + trans | 2.58 | 2.58 | 3.63 |
| 2-methyl pentane | — | — | — |
| 2-methyl 1-pentene | 2.89 | 0.85 | 1.2 |
| 2-methyl 2-pentene | 20.52 | 5.63 | 7.92 |
| 4-methyl 2-pentene trans | 8.83 | 8.83 | 12.42 |
| 4-methyl 2-pentene cis | 1.44 | 1.44 | 2.02 |
| 4-methyl 1-pentene | 0.43 | 0.43 | 0.6 |
| 2,3-dimethylbutane | — | — | — |
| 2,3-dimethyl 1-butene | 0.96 | 0.18 | 0.25 |
| 2,3-dimethyl 2-butene | 2.67 | 1.71 | 2.41 |
| methanol | 34.56 | 27.18 | — |
| dimethylether | — | 0.12 | — |
| 2-methyl 2-methoxypentane | — | 23.28 | 32.74 |
| 2,3-dimethyl 2-methoxybutane | — | 2.04 | 2.87 |
| 2-methyl 2-pentanol | — | 0.11 | 0.15 |
| 2,3-dimethyl 2-butanol | — | 0.06 | 0.08 |
| C9+ | 15.11 | 15.55 | 21.87 |

Clearly, if the whole of the DIMATE fraction is employed, this effluent can only be mixed with other gasolines and then only following elimination of the methanol by water washing, for example, which can then be recycled following distillation.

EXAMPLE 2

The example below illustrates etherification of a C6= fraction which is extracted by distillation of the total effluent of an industrial dimate and separation of the corresponding ethers.

The dimate described in the above example was first distilled to produce a C6= fraction which was free of heavy products.

The apparatus used was a column operating in batch mode which could treat batches of about 100 liters.

Nine batches were required to produce 398.4 kg of C6= fraction from 591.9 kg of crude dimate, as shown in Table 4 below.

True Boiling Point distillation was carried out to obtain a precise cut with a final boiling point of 70° C. (atmospheric pressure).

A glass column was packed with metallic packing material and mounted using a double walled system to ensure adiabatic operation. Condensation of the light compounds at the top was ensured by a high pressure glycol-water refrigerating set.

The configuration of the system was such that the C6= fraction of each batch was used up over one day (pressure drop across the column regulating the heating power fixed at 15 mm water, cut point 70° C. at the top, no higher than 125° C. at the bottom, reflux ratio about 0.5).

TABLE 4

| | | |
|---|---|---|
| Feedstock | (kg) | 591.9 |
| Distillate | (kg) | 398.4 |

TABLE 4-continued

| | | |
|---|---|---|
| Residue | (kg) | 169.8 |
| Losses | (kg) | 23.7 |

Table 5 below shows the average composition of the C6= fraction obtained from this distillation operation.

A comparison of the figures given in Tables 2 and 5 clearly shows that the loss produced by distillation mainly affects the 2,3-dimethyl 2-butene which is the heaviest of the hexenes (B.Pt=73.2° C.). This product is an etherifiable hexene; the cut point in this example was selected to be slightly lower than that corresponding to the separation optimum (about 75° C.).

The residue containing the C9+ olefins and a portion of the 2,3-dimethyl 2-butene constitutes a perfectly valid product in a gasoline pool.

TABLE 5

| Product name | Composition (weight %) |
|---|---|
| n-hexane | — |
| 1-hexene | 0.31 |
| 2-hexene trans | 12.87 |
| 2-hexene cis | 3.60 |
| 3-hexene cis + trans | 5.27 |
| 2-methyl pentane | — |
| 2-methyl 1-pentene | 6.14 |
| 2-methyl 2-pentene | 41.53 |
| 4-methyl 2-pentene trans | 18.97 |
| 4-methyl 1-pentene cis | 3.11 |
| 4-methyl 1-pentene | 0.93 |
| 2,3-dimethylbutane | 0.04 |
| 2,3-dimethyl 1-butene | 2.06 |
| 2,3-dimethyl 2-butene | 4.43 |

51.6 kg of methanol was added to 132.8 kg of this fraction, corresponding to a ratio of methanol to etherifiable olefins contained in the C6 fraction (the sum of the 2-methylpentenes and the 2,3-dimethylpentenes) of 1.9. 184.4 kg of a mixture which was ready to be etherified was obtained.

Etherification was carried out by introducing 128 g/h of feedstock, corresponding to an hourly specific flow rate of 0.8 $h^{-1}$ (parameters identical to those given for Example 1) into the apparatus of Example 1 using the same catalyst (89 g of AMBERLYST 15, ie, 222 ml wet). The conditions were generally identical to those described in the previous Example. A portion of the etherification effluent was then washed as in Example 1.

The experiment was continued for about two months without observing any catalyst deactivation or significant variations in the conversion yields or nature of the products formed.

Table 6 shows the average overall figures for the experiment.

TABLE 6

| Product name | Feedstock (wt %) | Effluent (wt %) | Gasoline (wt %) |
|---|---|---|---|
| n-hexane | — | — | — |
| 1-hexene | 0.22 | 0.22 | 0.27 |
| 2-hexene trans | 9.34 | 9.34 | 11.33 |
| 2-hexene cis | 2.61 | 2.61 | 3.17 |
| 3-hexene cis + trans | 3.82 | 3.82 | 4.64 |

TABLE 6-continued

| Product name | Feedstock (wt %) | Effluent (wt %) | Gasoline (wt %) |
|---|---|---|---|
| 2-methyl pentane | — | — | — |
| 2-methyl 1-pentene | 4.46 | 1.26 | 1.53 |
| 2-methyl 2-pentene | 30.14 | 8.32 | 10.1 |
| 4-methyl 2-pentene trans | 13.76 | 13.76 | 16.69 |
| 4-methyl 2-pentene cis | 2.25 | 2.25 | 2.73 |
| 4-methyl 1-pentene | 0.68 | 0.68 | 0.83 |
| 2,3-dimethylbutane | 0.03 | 0.03 | 0.04 |
| 2,3-dimethyl 1-butene | 1.50 | 0.23 | 0.28 |
| 2,3-dimethyl 2-butene | 3.21 | 2.17 | 2.63 |
| methanol | 27.98 | 17.50 | 0.02 |
| dimethylether | — | 0.12 | — |
| 2-methyl 2-methoxypentane | — | 34.40 | 41.75 |
| 2,3-dimethyl 2-methoxybutane | — | 3.12 | 3.79 |
| 2-methyl 2-pentanol | — | 0.11 | 0.13 |
| 2,3-dimethyl 2-butanol | — | 0.06 | 0.07 |

The third column in Table 6 shows the composition of the gasoline obtained after washing a portion of the effluent from the etherification reactor with water.

A second portion of the etherification effluent was topped in two batches on the same distillation column as that used to produce the C6= fraction from the crude dimate, under exactly the same conditions as those used during that separation: distillation at atmospheric pressure; cut point 70° C.; reflux ratio 0.5; pressure drop across column 15 mm water.

Table 7 shows the composition of the distillate and residue (the ether fraction) after distillation of a portion of the etherification effluent.

TABLE 7

| Product name | Feedstock (kg) | Distillate (kg) | Residue (kg) |
|---|---|---|---|
| n-hexane | — | — | — |
| 1-hexene | 0.41 | 0.41 | — |
| 2-hexene trans | 17.22 | 17.22 | — |
| 2-hexene cis | 4.81 | 4.81 | — |
| 3-hexene cis + trans | 7.04 | 7.04 | — |
| 2-methyl pentane | — | — | — |
| 2-methyl 1-pentene | 8.22 | 2.32 | — |
| 2-methyl 2-pentene | 55.58 | 15.34 | — |
| 4-methyl 2-pentene trans | 25.37 | 25.37 | — |
| 4-methyl 2-pentene cis | 4.15 | 4.15 | — |
| 4-methyl 1-pentene | 1.25 | 1.25 | — |
| 2,3-dimethylbutane | 0.06 | 0.06 | — |
| 2,3-dimethyl 1-butene | 2.77 | 0.42 | — |
| 2,3-dimethyl 2-butene | 5.92 | 2.40 | 1.60 |
| methanol | 51.60 | 32.23 | 0.04 |
| dimethylether | — | 0.22 | — |
| 2-methyl 2-methoxypentane | — | — | 63.43 |
| 2,3-dimethyl 2-methoxybutane | — | — | 5.75 |
| 2-methyl 2-pentanol | — | — | 0.20 |
| 2,3-dimethyl 2-butanol | — | — | 0.11 |
| Total | 184.4 | 113.24 | 71.13 |

It can thus be seen that 71.1 kg of the ether fraction (including the addition of 19.1 kg of methanol) was produced and 69.5% of the directly etherifiable olefins were converted.

The distillate can be further treated either to etherify a portion of the etherifiable olefins still present, or to transport the distillate to a gasoline pool after extraction of the methanol (about 81 kg remained).

The residue from the initial distillation (56.6 kg), as has been shown above, can also be incorporated into the gasoline pool.

EXAMPLE 3

The following example illustrates the concept of increasing the quantity of etherifiable olefins by addition of a hydroisomerisation step. Hydroisomerisation is followed by an etherification step then a step to separate the ethers produced.

The same quantity of C6= distillate (132.8 kg) obtained from distillation of a crude dimate as in Example 2 was used. In this case it was treated in the presence of hydrogen an da hydroisomerisation catalyst comprising palladium deposited on alumina (LD265 from PROCATALYSE, presulphurated in situ in the reaction zone).

The pilot unit operated in continuous mode and used 180 ml of catalyst in a 20 mm diameter pressurised tube reactor (the experiment was carried out under a controlled pressure of 2 MPa in the reaction zone). The reactor contained electrically heated baffles to ensure pseudo-isothermal operation in the reaction zone (about 70° C.).

In this experiment, the reactor was supplied, after furnace preheating, with a controlled ascending flow of C6= fraction (constant at 370 g/h; driven by a metering pump from external storage) and hydrogen (10N 1/h; supplied by pipeline through a pneumatic micro valve).

At the exit to the reactor and after cooling with water, the pressure in the effluent mixture from the reactor was released to 0.5 MPa in a vessel (total volume 250 ml); continuous extraction after separation of the stabilised liquid and gas was thus ensured.

It was not possible to maintain a constant pressure in the vessel since all the hydrogen was consumed under the operation conditions used and it was necessary to add a constant nitrogen flow (about 10N 1/h) above the pressure regulation valve directly into the top of the vessel.

Periodically, at least once a day, a sample of the liquid was removed and analysed by vapour phase chromatography.

The plant was operated for 15 days without observing any variation in catalyst activity or selectivity.

Table 8 below shows the average overall results of this experiment and gives the quantity by weight of the products contained in the hydrocarbon feedstock (dimate) and the hydroisomerisation effluent.

TABLE 8

| Product name | C6= Feedstock (wt %) | Hydroisomerisate (wt %) Temp: 70° C. Molar % H2:10 |
|---|---|---|
| n-hexane | — | 3.61 |
| 1-hexene | 0.31 | 0.33 |
| 2-hexene trans | 12.87 | 10.45 |
| 2-hexene cis | 3.6 | 3.24 |
| 3-hexene cis + trans | — | 4.5 |
| linear sum | 22.05 | 22.13 |
| % by wt hydrogenated | — | 16.31 |
| 2-methyl pentane | — | 3.36 |
| 2-methyl 1-pentene | 6.14 | 7.78 |
| 2-methyl 2-pentene | 41.53 | 47.42 |
| 4-methyl 2-pentene trans | 18.97 | 10.42 |
| 4-methyl 2-pentene cis | 3.11 | 1.78 |
| 4-methyl 1-pentene | 0.93 | 0.56 |
| mono-branched sum | 70.68 | 71.32 |
| % by wt hydrogenated | — | 4.71 |
| % by wt etherifiable | 67.44 | 77.4 |
| 2,3-dimethylbutane | 0.04 | 0.11 |
| 2,3-dimethyl 1-butene | 2.06 | 1.03 |
| 2,3-dimethyl 2-butene | 4.43 | 5.41 |
| di-branched sum | 6.53 | 6.55 |

TABLE 8-continued

| Product name | C6= Feedstock (wt %) | Hydroisomerisate (wt %) Temp: 70° C. Molar % H2:10 |
|---|---|---|
| % by wt hydrogenated | 0.61 | 1.68 |
| % by wt etherifiable | 6.49 | 98.32 |
| total hydrogenated | 0.04 | 7.08 |
| total etherifiable | 54.19 | 61.64 |

59.8 kg of methanol was added to 132.8 kg of the hydroisomerisation effluent, corresponding to a ratio of methanol to etherifiable olefins contained in the fraction (the sum of the 2-methylpentenes and 2,3-dimethylbutenes) of 1.9. 192 kg of a mixture ready for etherification was thus obtained.

The conditions of Example 2 were repeated. Table 9 shows the average overall results of etherification of the hydroisomerisation effluent.

TABLE 9

| Product name | Feedstock (wt %) | Effluent (wt %) | Gasoline (wt %) |
|---|---|---|---|
| n-hexane | 2.50 | 2.50 | 3.11 |
| 1-hexene | 0.23 | 0.23 | 0.29 |
| 2-hexene trans | 7.23 | 7.23 | 8.98 |
| 2-hexene cis | 2.24 | 2.24 | 2.78 |
| 3-hexene cis + trans | 3.11 | 3.11 | 3.86 |
| 2-methyl pentane | 2.32 | 2.32 | 2.88 |
| 2-methyl 1-pentene | 5.38 | 1.29 | 1.60 |
| 2-methyl 2-pentene | 32.80 | 9.25 | 11.49 |
| 4-methyl 2-pentene trans | 7.21 | 7.21 | 8.96 |
| 4-methyl 2-pentene cis | 1.23 | 1.23 | 1.53 |
| 4-methyl 1-pentene | 0.39 | 0.39 | 0.48 |
| 2,3-dimethylbutane | 0.08 | 0.08 | 0.10 |
| 2,3-dimethyl 1-butene | 0.71 | 0.21 | 0.26 |
| 2,3-dimethyl 2-butene | 3.74 | 2.06 | 2.56 |
| methanol | 30.83 | 19.41 | 0.03 |
| dimethylether | — | 0.12 | |
| 2-methyl 2-methoxypentane | — | 37.99 | 47.20 |
| 2,3-dimethyl 2-methoxybutane | — | 2.96 | 3.68 |
| 2-methyl 2-pentanol | — | 0.11 | 0.14 |
| 2,3-dimethyl 2-butanol | — | 0.06 | 0.07 |

The third column of Table 9 shows the composition of the resulting gasoline after washing a portion of the effluent from the etherification reactor with water.

A major portion of the effluent was topped in two batches on the same distillation column as that used to produce the C6= fraction from the crude dimate, under exactly the same conditions as those used during that separation: distillation at atmospheric pressure; cut point 70° C.; reflux ratio 0.5; pressure drop across column 15 mm water.

Table 10 shows the composition of the distillate and residue (the ether fraction).

TABLE 10

| Product name | Feedstock kg | Distillate kg | Residue kg |
|---|---|---|---|
| n-hexane | 4.79 | 4.79 | — |
| 1-hexene | 0.44 | 0.44 | — |
| 2-hexene trans | 13.88 | 13.88 | — |
| 2-hexene cis | 4.30 | 4.30 | — |
| 3-hexene cis + trans | 5.98 | 5.98 | — |
| 2-methyl pentane | 4.46 | 4.46 | — |
| 2-methyl 1-pentene | 10.33 | 2.48 | — |

TABLE 10-continued

| Product name | Feedstock kg | Distillate kg | Residue kg |
|---|---|---|---|
| 2-methyl 2-pentene | 62.97 | 17.76 | — |
| 4-methyl 2-pentene trans | 13.84 | 13.84 | — |
| 4-methyl 2-pentene cis | 2.36 | 2.36 | — |
| 4-methyl 1-pentene | 0.74 | 0.74 | — |
| 2,3-dimethylbutane | 0.15 | 0.15 | — |
| 2,3-dimethyl 1-butene | 1.37 | 0.40 | — |
| 2,3-dimethyl 2-butene | 7.18 | 2.38 | 1.58 |
| methanol | 59.20 | 37.21 | 0.06 |
| dimethylether | — | 0.23 | — |
| 2-methyl 2-methoxypentane | — | — | 72.94 |
| 2,3-dimethyl 2-methoxybutane | — | — | 5.68 |
| 2-methyl 2-pentanol | — | — | 0.21 |
| 2,3-dimethyl 2-butanol | — | — | 0.11 |
| Total | 191.99 | 111.40 | 80.58 |

It can thus be seen that 80.5 kg of ether fraction (including the addition of 21.9 kg of methanol) was produced and 71.9% of the etherifiable olefins were converted.

The distillate can be further treated either to etherify a portion of the etherifiable olefins still present, or to transport the distillate to a gasoline pool after extraction of the methanol (about 74.2 kg remained).

The residue from the initial distillation (56.6 kg), as has been shown above, can also be incorporated into the gasoline pool.

EXAMPLE 4

The example below illustrates etherification of a C6= fraction which is extracted by distillation of the total effluent of an industrial dimate from a unit comprising an end reactor, and separation of the corresponding ethers.

Table 11 below shows the average composition of the C6= fraction obtained after distillation.

TABLE 11

| Product name | Composition (weight %) |
|---|---|
| n-hexane | — |
| 1-hexene | 0.3 |
| 2-hexene trans | 13.17 |
| 2-hexene cis | 3.78 |
| 3-hexene cis + trans | 5.29 |
| 2-methyl pentane | — |
| 2-methyl 1-pentene | 7.35 |
| 2-methyl 2-pentene | 52.16 |
| 4-methyl 2-pentene trans | 8.74 |
| 4-methyl 1-pentene cis | 1.41 |
| 4-methyl 1-pentene | 0.37 |
| 2,3-dimethylbutane | — |
| 2,3-dimethyl 1-butene | 1.98 |
| 2,3-dimethyl 2-butene | 5.47 |

62.7 kg of methanol was added to 129.3 kg of this fraction, corresponding to a ratio of methanol to etherifiable olefins contained in the C6fraction (the sum of the 2-methylpentenes and the 2,3-dimethylbutenes) of 1.9. 192 kg of the mixture to be etherified was thus obtained.

The conditions of Example 2 were repeated. Table 12 shows the average results of the etherification of the C6 fraction obtained by oligomerisation as described above.

TABLE 12

| Product name | Feedstock (wt %) | Effluent (wt %) | Gasoline (wt %) |
|---|---|---|---|
| n-hexane | — | — | — |
| 1-hexene | 0.20 | 0.20 | 0.25 |
| 2-hexene trans | 8.87 | 8.87 | 11.2 |
| 2-hexene cis | 2.54 | 2.54 | 3.21 |
| 3-hexene cis + trans | 3.56 | 3.56 | 4.49 |
| 2-methyl pentane | — | — | — |
| 2-methyl 1-pentene | 4.95 | 1.42 | 1.79 |
| 2-methyl 2-pentene | 35.13 | 10.20 | 12.88 |
| 4-methyl 2-pentene trans | 5.87 | 5.87 | 7.41 |
| 4-methyl 2-pentene cis | 0.97 | 0.97 | 1.22 |
| 4-methyl 1-pentene | 0.25 | 0.25 | 0.32 |
| 2,3-dimethylbutane | — | — | — |
| 2,3-dimethyl 1-butene | 1.33 | 0.23 | 0.29 |
| 2,3-dimethyl 2-butene | 3.68 | 2.22 | 2.80 |
| methanol | 32.65 | 20.72 | 0.05 |
| dimethylether | — | 0.13 | — |
| 2-methyl 2-methoxypentane | — | 39.18 | 49.47 |
| 2,3-dimethyl 2-methoxybutane | — | 3.47 | 4.40 |
| 2-methyl 2-pentanol | — | 0.11 | 0.14 |
| 2,3-dimethyl 2-butanol | — | 0.06 | 0.08 |

The third column in Table 12 shows the composition of the gasoline obtained after washing a minor portion of the effluent product from the etherification reactor with water.

A second portion of the etherification effluent was topped in two batches on the same distillation column as that used to produce the C6= fraction from the crude dimate, under exactly the same conditions as those used during that separation: distillation at atmospheric pressure; cut point 70° C.; reflux ratio 0.5; pressure drop across column 15 mm water.

Table 13 shows the composition of the distillate and residue (the ether fraction) after distillation of a portion of the etherification effluent.

TABLE 13

| Product name | Feedstock kg | Distillate kg | Residue kg |
|---|---|---|---|
| n-hexane | — | — | — |
| 1-hexene | 0.38 | 2.73 | — |
| 2-hexene trans | 17.03 | 17.03 | — |
| 2-hexene cis | 4.88 | 4.88 | — |
| 3-hexene cis + trans | 6.83 | 6.83 | — |
| 2-methyl pentane | — | — | — |
| 2-methyl 1-pentene | 9.50 | 2.73 | — |
| 2-methyl 2-pentene | 67.45 | 19.58 | — |
| 4-methyl 2-pentene trans | 11.27 | 11.27 | — |
| 4-methyl 2-pentene cis | 1.86 | 1.86 | — |
| 4-methyl 1-pentene | 0.48 | 0.48 | — |
| 2,3-dimethylbutane | — | — | — |
| 2,3-dimethyl 1-butene | 2.55 | 0.44 | — |
| 2,3-dimethyl 2-butene | 7.07 | 2.56 | 1.70 |
| methanol | 62.69 | 39.72 | 0.06 |
| dimethylether | — | 0.25 | — |
| 2-methyl 2-methoxypentane | — | — | 75.22 |
| 2,3-dimethyl 2-methoxybutane | — | — | 6.66 |
| 2-methyl 2-pentanol | — | — | 0.21 |
| 2,3-dimethyl 2-butanol | — | — | 0.12 |
| Total | 191.9 | 108.01 | 83.97 |

It can thus be seen that 84 kg of the ether fraction was produced and 68.8% of the directly etherifiable olefins were converted.

The distillate can be further treated either to etherify a portion of the etherifiable olefins still present, or to transport the distillate to a gasoline pool after extraction of the methanol (about 68.3 kg remained).

EXAMPLE 5

The example below illustrates etherification of the distillate obtained from example 4, whose composition by weight is given in Table 13. Etherification was carried out following the etherification method described in the preceding examples.

Table 14 shows the overall results for this experiment.

TABLE 14

| Product name | Feedstock (wt %) | Effluent (wt %) | Gasoline (wt %) |
|---|---|---|---|
| n-hexane | — | — | — |
| 1-hexene | 0.35 | 0.35 | 0.50 |
| 2-hexene trans | 15.76 | 15.76 | 22.74 |
| 2-hexene cis | 4.52 | 4.52 | 6.52 |
| 3-hexene cis + trans | 6.32 | 6.32 | 9.11 |
| 2-methyl pentane | — | — | — |
| 2-methyl 1-pentene | 2.53 | 0.68 | 0.98 |
| 2-methyl 2-pentene | 18.13 | 4.90 | 7.07 |
| 4-methyl 2-pentene trans | 10.43 | 10.43 | 15.05 |
| 4-methyl 2-pentene cis | 1.72 | 1.72 | 2.48 |
| 4-methyl 1-pentene | 0.44 | 0.44 | 0.63 |
| 2,3-dimethylbutane | — | — | — |
| 2,3-dimethyl 1-butene | 0.41 | 0.20 | 0.25 |
| 2,3-dimethyl 2-butene | 2.37 | 1.14 | 1.64 |
| methanol | 36.79 | 30.43 | 0.05 |
| dimethylether | 0.23 | 0.30 | — |
| 2-methyl 2-methoxypentane | — | 20.75 | 29.96 |
| 2,3-dimethyl 2-methoxybutane | — | 1.94 | 2.8 |
| 2-methyl 2-pentanol | — | 0.08 | 0.12 |
| 2,3-dimethyl 2-butanol | — | 0.04 | 0.06 |

The third column in Table 14 shows the composition of the gasoline obtained after washing a minor portion of the effluent product from the etherification reactor with water.

A second portion of the etherification effluent was topped in two batches on the same distillation column as that used to produce the C6= fraction from the crude dimate, under exactly the same conditions as those used during that separation: distillation at atmospheric pressure; cut point 72° C.; reflux ratio 0.5; pressure drop across column 15 mm water.

Table 15 shows the composition of the distillate and residue (the ether fraction) after distillation of a portion of the etherification effluent.

TABLE 15

| Product name | Feedstock kg | Distillate kg | Residue kg |
|---|---|---|---|
| n-hexane | — | — | — |
| 1-hexene | 0.38 | 0.38 | — |
| 2-hexene trans | 17.02 | 17.02 | — |
| 2-hexene cis | 4.88 | 4.88 | — |
| 3-hexene cis + trans | 6.82 | 6.82 | — |
| 2-methyl pentane | — | — | — |
| 2-methyl 1-pentene | 2.73 | 0.73 | — |
| 2-methyl 2-pentene | 19.58 | 5.29 | — |
| 4-methyl 2-pentene trans | 11.26 | 11.26 | — |
| 4-methyl 2-pentene cis | 1.86 | 1.86 | — |
| 4-methyl 1-pentene | 0.48 | 0.48 | — |
| 2,3-dimethylbutane | — | — | — |
| 2,3-dimethyl 1-butene | 0.44 | 0.22 | — |
| 2,3-dimethyl 2-butene | 2.56 | 0.73 | 0.50 |
| methanol | 39.73 | 32.81 | 0.05 |
| dimethylether | 0.24 | 0.30 | — |
| 2-methyl 2-methoxypentane | — | — | 22.41 |
| 2,3-dimethyl 2-methoxybutane | — | — | 2.10 |

TABLE 15-continued

| Product name | Feedstock kg | Distillate kg | Residue kg |
|---|---|---|---|
| 2-methyl 2-pentanol | — | — | 0.09 |
| 2,3-dimethyl 2-butanol | — | — | 0.04 |
| Total | 107.9 | 82.8 | 25.2 |

It can thus be seen that 25.2 kg of the supplementary ether fraction was produced (the sum of the ethers produced from Example 4+Example 5 was 109.2 kg) and 70.5% of the directly etherifiable olefins were converted (in total of Example 4+Example 5 shows that more than 90% of etherifiable olefins were etherified).

After extraction of the methanol by washing, the distillate could be transported to the gasoline pool.

The entire disclosure of all applications, patents and publications, cited above and below, and of corresponding French application No. 93/06.474, filed May 28, 1993, are hereby incorporated by reference.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

We claim:

1. A process for producing a fuel suitable for an internal combustion engine, produced from a hydrocarbon mixture comprising etherifiable and non-etherifiable hydrocarbons containing 5 to 8 carbon atoms, said process comprising:

distilling said hydrocarbon mixture to obtain a top fraction enriched in $C_6$ hydrocarbons and a bottom fraction enriched in hydrocarbons containing more than 6 carbon atoms, said top fraction containing etherifiable and non-etherifiable olefins;

subjecting said top fraction to an isomerization step to convert said non-etherifiable olefins to etherifiable olefins;

catalytically etherifying at least a portion of the etherifiable olefins contained in the resultant produce from the isomerization step with at least one alcohol containing 1 to 4 carbon atoms, said alcohol being employed at an alcohol: etherifiable olefin molar ratio of at least 1:1; and washing at least a portion of the resultant ether containing product with water.

2. A process to claim 1 wherein the hydrocarbon mixture comprising hydrocarbons containing 5 to 8 carbon atoms is a mixture resulting from catalytic homogeneous or heterogeneous phase oligomerization of at least one olefin containing 2 to 2 carbon atoms under conditions sufficient to produce at least one branched olefin containing 5 to 8 carbon atoms and comprising an internal triple-substituted carbon-carbon double bond or an external double-substituted double bond.

3. A process according to claim 1 wherein the hydrocarbon mixture comprising hydrocarbons containing 5 to 8 carbon atoms is a mixture from a cracking reaction.

4. A process according to claim 1 wherein the isomerization step for the non etherifiable olefins present in the top fraction constitutes an isomerization step for said top fraction enriched in hydrocarbons containing 6 carbon atoms, wherein the linear olefins present are isomerization at least in part to branched olefins comprising an internal triple-substituted carbon-carbon double bond or an external double-substituted double bond.

5. A process according to claim 4 wherein isomerized is carried out in the presence of hydrogen.

6. A process according to claim 1 wherein the process comprises a distillation step for the mixture resulting from the etherification step, during which an ether enriched bottom fraction is separated and recovered and a hydrocarbon enriched top fraction is transported to the washing step.

7. A process according to claim 1, further comprising subjecting at least a portion of the resultant etherification effluent to distillation to produce a distillate and a residue ether fraction.

8. A process according to claim 1, further comprising subjecting said distillate to an etherification to etherify at least a portion of residual etherifiable olefins in said distillate.

* * * * *